US007322129B2

(12) United States Patent
Michaeli

(10) Patent No.: US 7,322,129 B2
(45) Date of Patent: Jan. 29, 2008

(54) FOOTWEAR SOLE COMPRISING A SHOCK-ABSORBING DEVICE

(75) Inventor: Martin Michaeli, Zürich (CH)

(73) Assignee: Mephisto S.A., Sarrebourg (FR)

( * ) Notice: Subject to any disclaimer, the term of this patent is extended or adjusted under 35 U.S.C. 154(b) by 347 days.

(21) Appl. No.: 10/543,770

(22) PCT Filed: Feb. 12, 2004

(86) PCT No.: PCT/FR2004/000324

§ 371 (c)(1),
(2), (4) Date: Jul. 29, 2005

(87) PCT Pub. No.: WO2004/073438

PCT Pub. Date: Sep. 2, 2004

(65) Prior Publication Data

US 2006/0117605 A1 Jun. 8, 2006

(30) Foreign Application Priority Data

Feb. 14, 2003 (FR) ..... 03 01836

(51) Int. Cl.
*A43B 13/20* (2006.01)

(52) U.S. Cl. ..... 36/35 B; 36/28; 36/29; 36/35 R

(58) Field of Classification Search ..... 36/29, 36/28, 35 R, 35 B
See application file for complete search history.

(56) References Cited

U.S. PATENT DOCUMENTS

| | | | | |
|---|---|---|---|---|
| 5,175,946 | A * | 1/1993 | Tsai | 36/29 |
| 5,369,896 | A * | 12/1994 | Frachey et al. | 36/29 |
| 5,787,609 | A * | 8/1998 | Wu | 36/28 |
| 5,815,949 | A * | 10/1998 | Sessa | 36/3 B |
| 5,918,383 | A * | 7/1999 | Chee | 36/28 |
| 6,176,025 | B1 | 1/2001 | Patterson et al. | |
| 6,205,684 | B1 * | 3/2001 | Snyder | 36/35 R |
| 2005/0160626 | A1 * | 7/2005 | Townsend | 36/30 R |

FOREIGN PATENT DOCUMENTS

| | | |
|---|---|---|
| EP | 0 399 332 | 11/1990 |
| FR | 2 577 119 | 8/1986 |
| FR | 2 731 597 | 9/1996 |
| FR | 2 774 565 | 8/1999 |

* cited by examiner

*Primary Examiner*—Ted Kavanaugh
(74) *Attorney, Agent, or Firm*—Young & Thompson

(57) ABSTRACT

The invention relates to a sole for a footwear item. The invention essentially comprises a sock lining (1), an insole (2) and an outsole (3) as well as a shock-absorbing device (4). The inventive sole is characterised in that the aforementioned shock-absorbing device is an elastically-deformable element or insert (4) which is inserted into the sole in the form of a moulded body (4) comprising mutually-spaced tubular pieces (4') having one closed end and one open end which is connected to a common base (4").

10 Claims, 2 Drawing Sheets

FOOTWEAR SOLE COMPRISING A SHOCK-ABSORBING DEVICE

Figure 1:
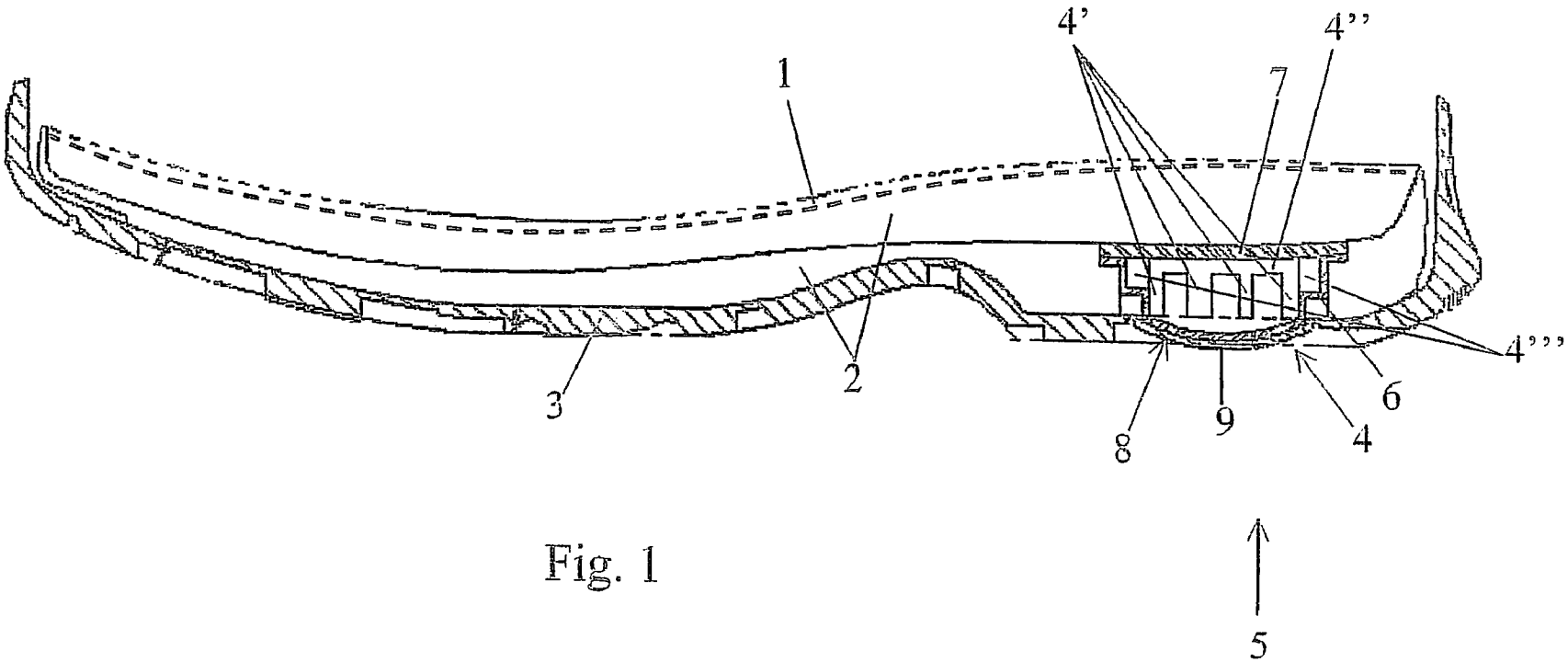

This application is a 317 of PCT/FR04/00324 filed Feb. 12, 2004.

The present invention relates to footwear soles and has for its object such a sole comprising a shock absorbing device.

Soles of this type have the object of providing better walking comfort, the least sensation of fatigue and ensuring shock absorption.

Several solutions exist at present to absorb shock due to contact of the sole with the ground.

A first solution consists in inserting between the different layers constituting the sole, namely the outsole, the insole and the stocking liner, a layer of shock absorbing material. This embodiment however has the drawback of making the footwear heavy and increasing the height of the sole, thereby rendering its use less suitable.

Another solution consists in inserting an air cushion into the heel of the footwear. This gives rise to the problem of protecting the air chamber. Thus, there is a risk of deflation and loss of effectiveness when the user walks on a pointed or sharp object.

Numerous other solutions have been proposed. Thus, FR 2 577 119 discloses a footwear sole provided with a device for restitution of energy. In this case, the sole comprises a piston slidably mounted in a sleeve in the heel and projecting relative to the surface of the heel. However, this embodiment has a major drawback, namely, that the device adapted for energy restitution impedes walking, because the walker feels, with each step, this device sinking into the heel. Moreover, said device has a very high risk of causing stumbling and falling and is not suitable for use on un-level or broken ground.

Another solution is provided by U.S. Pat. No. 4,616,431 relating to a sport footwear sole, in which are mounted devices for absorbing shocks in the form of discs inserted in cylinders, a piston being mounted in each of said cylinders to exert a pressure against said discs in the loaded condition, which is to say when the foot rests on the ground. This embodiment is not impressive, because the shock absorption is limited because the discs are superposed and the shock absorption depends on the possibility of compressing said discs.

The same is true for devices disclosed DE 29 01 084, FR 2 774 565, U.S. Pat. No. 6,176,025 and EP0 399 332, in which the elements adapted to absorb shocks have a relatively low capacity for deformation, limiting their effectiveness.

French Patent 2 731 597 in the name of the applicant, discloses a shock absorbing device permitting improving this capacity to absorb shocks, in which an insert is mounted in the heel of the sole, this insert being constituted by elements in the form of fingers adapted to be compressed during walking. This embodiment is limited because the fingers are relatively small and because they are disposed in a fairly dense manner, which does not promote their deformation and hence their capacity for absorbing shocks. The device according to this document is more for improving the comfort of the heel than for absorbing shocks.

The present invention has particularly for its object further to improve shock absorption, overcoming the drawbacks mentioned above and to provide a solution permitting providing a sole comprising a shock absorbing device, providing important absorption of shocks independently of the terrain, and particularly over non-uniform terrains, and whose insertion in the sole does not modify the shape of this latter, which keeps its effectiveness, even when said device is pierced. Moreover, this device can be used in numerous types of footwear.

To this end, it has for its object a sole for a footwear article, essentially constituted by a sock liner, an insole and an outsole and comprising at least one shock absorbing device, characterized in that said shock absorbing device is an elastically deformable element, inserted in said sole and in the form of a molded body constituted by tubular members, closed at one end, mutually spaced and connected at their open end to a common base.

Figure 2:
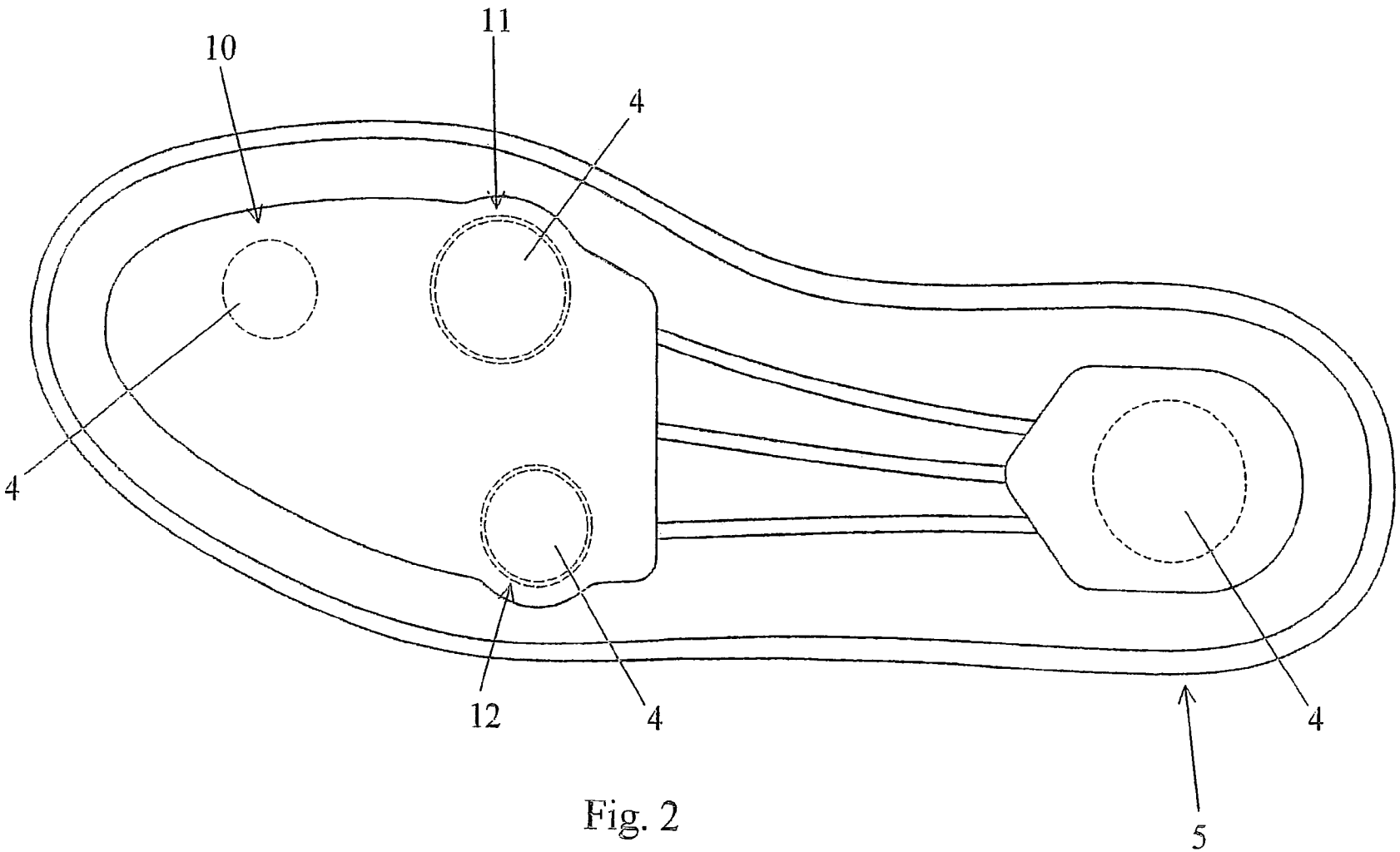

The invention will be better understood from the following description, which relates to a preferred embodiment, given by way of non-limiting example, and explained with reference to the accompanying schematic drawings, in which:

FIG. 1 is a longitudinal cross-sectional view of the sole according to one embodiment of the invention, and FIG. 2 is a simplified bottom plan view of the sole according to another embodiment of the invention.

FIG. 1 of the accompanying drawings shows, by way of example, a sole which is essentially constituted by a sock lining 1, an insole 2 and an outsole 3 and which comprises at least one shock absorbing device 4.

According to the invention, this shock absorbing device 4 can be an elastically deformable insert or element, inserted in said sole and in the form of a molded body constituted by tubular members 4', closed at one end, mutually spaced and connected at their open end to a common base 4".

The elastically deformable insert or element is preferably mounted in the insole 2. This embodiment of the shock absorbing device 4 as an insert permits introducing this latter into all soles of footwear articles by simple provision in their sole of a recess adapted to receive said shock absorbing device 4. This characteristic is advantageous, because it permits standardizing the production of soles provided with such devices 4 and thereby promotes the reduction of cost of the manufacturer of these soles.

According to one characteristic of the invention, the common base 4" can have a peripheral skirt 4'" delimiting a chamber receiving the closed ends of the tubular members 4'. There is thus obtained a shock absorbing device having an open cell structure with perfectly directed deformation which promotes the stability of the footwear and permits providing absorption of the shocks in a completely uniform and vertical manner.

According to the invention, the elastically deformable member 4 can be disposed in a closed flexible receptacle 6 sealed by a cover 7.

The constituent material of said elastically deformable molded body 4 can preferably be selected as a function of its shock absorbing properties.

So as to achieve optimum absorption of shocks, and according to a preferred embodiment of the invention, the flexible receptacle 6 can form a vertical peripheral chamber about the elastically deformable molded body 4 and said elastically deformable molded body 4 can be in contact with the cover 7 and with the portion of the flexible receptacle 6 opposite said cover 7.

This vertical peripheral chamber thus permits improving the shock absorption because, in addition to deforming during shock, it is separated from the elastically deformable molded body 4 by a volume into which said molded body 4 can entirely and freely deform during a shock, without being hindered by the walls of the flexible receptacle 6, and thus absorb gently the energy of the shock.

The portion of the flexible receptacle 6 opposite the cover 7 can preferably have a centering and folding device 8 for the elastically deformable molded body 4, permitting ensuring the good operation of this shock absorbing device 4. Thus, the centering and holding device 8 for the elastically deformable molded body 4 guarantees a stable positioning of said molded body 4 in the flexible receptacle 6 and thereby uniform shock absorption in the molded body 4 and, because of this, the effectiveness of the shock absorbing device.

According to a characteristic of the invention, the centering and holding device 8 for the elastically deformable molded body 4 can preferably be present in the form of a central cup, provided in the portion of the flexible receptacle 6 opposite the cover 7 and matching intimately the shape of the elastically deformable molded body 4 over a portion of its height.

According to a modified embodiment of the invention (not shown), the centering and holding device 8 for the elastically deformable molded body 4, in the portion of the flexible receptacle 6 opposite the cover 7, can also be made in the form of a projecting portion penetrating in a centered manner the elastically deformable molded body 4.

According to another embodiment (not shown), the elastically deformable molded body 4 can be in intimate contact with the interior surface of the flexible receptacle 6. In this case, during shock, the flexible receptacle 6 does not hinder the deformation of the elastically deformable molded body 4 and itself deforms because of its elastic properties.

According to another characteristic of the invention, the outsole can be provided with a lower element 9 for protection of the elastically deformable receptacle 6, integrated with said outsole by molding. This element 9 ensures the protection of the elastically deformable receptacle 6 against wear during walking, and also against penetration of dirt such as rust, water or the like.

As a function of the use of the footwear and of the needs of its user, and according to an embodiment of the invention, at least one elastically deformable element 4 can preferably be inserted in the heel portion 5 of the sole.

To absorb shocks at the front of the foot, and in according to an embodiment of the invention, at least one elastically deformable element 4 can be inserted into the sole, at at least three bearing points 10, 11 and 12 forming the support triangle of the front of the foot (see FIG. 2).

According to a modified embodiment of the invention (not shown), the receptable or receptacles 6 can open by their lower face through the outsole 3. This or these receptacles 6 do not hinder the user during walking, because they compress when this latter places the foot on the ground, whilst absorbing the shocks. Moreover, such an embodiment permits obtaining a simplified sole at least cost.

Of course, the invention is not limited to the embodiment described and shown in the accompanying drawings. Modifications remain possible, particularly as to the construction of the various elements or by substitution of technical equivalents, without thereby departing from the scope of protection of the invention.

The invention claimed is:

1. Sole for a footwear article, essentially constituted by a stocking liner (1), an insole (2) and an outsole (3) and comprising at least one shock absorbing device (4), in the form of an elastically deformable insert or element (4), inserted in said sole and in the form of a molded body (4) constituted by tubular members (4') closed at one end, mutually spaced and connected at their open end to a common base (4"), characterized in that said common base (4") has a peripheral skirt (4''') delimiting a chamber receiving the closed ends of the tubular members (4'), in that the elastically deformable element (4) is disposed in a flexible receptacle (6) closed in a sealed manner by a cover (7) and in that the outsole (3) is provided with a lower element (9) for protection of the elastically deformable receptacle (6) integrated with said outsole (3) by molding.

2. Sole for a footwear article, according to claim 1, characterized in that the flexible receptable (6) forms a vertical peripheral chamber about the elastically deformable molded body (4) and in that said elastically deformable molded body (4) is in contact with the cover (7) and with the portion of the flexible receptacle (6) opposite said cover (7).

3. Sole for a footwear article, according to claim 2, characterized in that the portion of the flexible receptacle (6) opposite the cover (7) has a centering and holding device (8) for the elastically deformable molded body (4).

4. Sole for a footwear article, according to claim 3, characterized in that the centering and holding device (8) for the elastically deformable molded body (4) is present in the form of a central cup, provided in the portion of the flexible receptacle (6) opposite the cover (7), and intimately matching the contour of the elastically deformable molded body (4) over a portion of its height.

5. Sole for a footwear article, according to claim 3, characterized in that the centering and holding device (8) for the elastically deformable molded body (4) is provided in the portion of the flexible receptacle (6) opposite the cover (7) and is present in the form of a projecting portion penetrating in a centered manner the elastically deformable molded body (4).

6. Sole for a footwear article, according to claim 2, characterized in that the elastically deformable molded body (4) is in intimate contact with the internal surface of the flexible receptacle (6).

7. Sole for a footwear article, according to claim 1, characterized in that at least one elastically deformable element (4) is inserted in the heel portion (5) of the sole.

8. Sole for a footwear article, according to claim 1, characterized in that at least one elastically deformable element (4) is inserted in the sole, at one of three bearing points (10, 11 and 12) forming the support triangle for the front of the foot.

9. Sole for a footwear article, according to claim 7, characterized in that the receptacle or receptacles (6) open by their lower surface through the outsole (3).

10. Sole for a footwear article, according to claim 8, characterized in that the receptacle or receptacles (6) open by their lower surface through the outsole (3).

* * * * *